US009957684B2

(12) United States Patent
Suver et al.

(10) Patent No.: US 9,957,684 B2
(45) Date of Patent: May 1, 2018

(54) SYSTEMS AND METHODS FOR INSTALLING PILE STRUCTURES IN PERMAFROST

(71) Applicant: American Piledriving Equipment, Inc., Kent, WA (US)

(72) Inventors: Paul Suver, Kent, WA (US); Matthew E. Fenwick, Kent, WA (US)

(73) Assignee: American Piledriving Equipment, Inc., Kent, WA (US)

( * ) Notice: Subject to any disclaimer, the term of this patent is extended or adjusted under 35 U.S.C. 154(b) by 0 days. days.

(21) Appl. No.: 15/372,196

(22) Filed: Dec. 7, 2016

(65) Prior Publication Data

US 2017/0167102 A1 Jun. 15, 2017

Related U.S. Application Data

(60) Provisional application No. 62/266,379, filed on Dec. 11, 2015.

(51) Int. Cl.

| | |
|---|---|
| ***E02D 7/00*** | (2006.01) |
| ***E02D 5/52*** | (2006.01) |
| ***E02D 5/24*** | (2006.01) |

(52) U.S. Cl.

CPC ..... *E02D 5/526* (2013.01); *E02D 5/24* (2013.01); *E02D 7/00* (2013.01); *E02D 2250/0023* (2013.01); *E02D 2250/0038* (2013.01); *E02D 2300/0023* (2013.01)

(58) Field of Classification Search

CPC combination set(s) only.

See application file for complete search history.

(56) References Cited

U.S. PATENT DOCUMENTS

| | | | |
|---|---|---|---|
| 48,515 | A | 7/1865 | Campbell et al. |
| 500,780 | A | 7/1893 | Simon |
| 628,962 | A | 7/1899 | Speer |
| 910,421 | A | 1/1909 | Schlueter |
| 999,334 | A | 8/1911 | Pearson |
| 1,288,989 | A | 12/1918 | Rees |
| 1,294,154 | A | 2/1919 | Payne |
| 1,322,470 | A | 11/1919 | Schenk |
| 1,464,231 | A | 8/1923 | Yezek |
| 1,654,093 | A | 12/1927 | Reid |

(Continued)

FOREIGN PATENT DOCUMENTS

| | | | |
|---|---|---|---|
| CA | 2394894 | A1 | 8/2003 |
| CA | 2942801 | * | 10/2015 |

(Continued)

OTHER PUBLICATIONS

USPTO, "Non-Final Office Action, U.S. Appl. No. 15/285,326,", dated Apr. 25, 2017, 10 pages.

(Continued)

*Primary Examiner* — Sean Andrish

(74) *Attorney, Agent, or Firm* — Michael R. Schacht; Schacht Law Office, Inc.

(57) ABSTRACT

A pile system for permafrost comprising a pilot hole, at least one pile, and frozen slurry. The pilot hole is formed to a pilot hole depth. The at least one pile is arranged at least partly within the pilot hole and extends to a pile string depth. The frozen slurry is within the pilot hole and is at least partly around the at least one pile.

14 Claims, 6 Drawing Sheets

(56) References Cited

U.S. PATENT DOCUMENTS 1,684,816 A 9/1928 Arden
1,787,000 A 12/1930 Hunt
1,903,555 A 4/1933 Robertson
2,101,285 A 12/1937 Stevens
2,128,428 A 8/1938 Murray, Jr.
2,232,845 A 2/1941 Fieroh
2,239,024 A 4/1941 Vance
2,350,921 A 6/1944 Pinazza
2,436,251 A 2/1948 Dobie et al.
2,439,219 A 4/1948 O'Connor
2,577,252 A 12/1951 Kjellman
2,760,747 A 8/1956 Mordarski
2,952,132 A 9/1960 Urban
2,975,846 A 3/1961 Bodine
3,004,389 A 10/1961 Muller
3,059,436 A 10/1962 Hermann, Jr.
3,106,258 A 10/1963 Muller
3,115,198 A 12/1963 Kuss
3,172,485 A 3/1965 Spannhake et al.
3,175,630 A 3/1965 Hein et al.
3,278,235 A 10/1966 Bergstrom
3,280,924 A 10/1966 Tatamikov
3,287,983 A 11/1966 Austin et al.
3,300,987 A 1/1967 Maeda
3,313,376 A 4/1967 Holland
3,371,727 A 3/1968 Belousov et al.
3,381,422 A 5/1968 Olson
3,391,435 A 7/1968 Lebelle
3,394,766 A 7/1968 Lebelle
3,396,805 A 8/1968 Muller
3,411,305 A 11/1968 Cella
3,412,813 A 11/1968 Johnson
3,460,637 A 8/1969 Schulin
3,513,587 A 5/1970 Artur
3,528,302 A 9/1970 Kinnan
3,530,947 A 9/1970 Gendron
3,577,645 A 5/1971 Zurawski
3,583,497 A 6/1971 Kossowski et al.
3,684,037 A 8/1972 Bodine
3,686,877 A 8/1972 Bodin
3,711,161 A 1/1973 Proctor et al.
3,786,874 A 1/1974 Demichelis et al.
3,808,820 A 5/1974 Bodine
3,828,864 A 8/1974 Haverkamp et al.
3,865,501 A 2/1975 Kniep
3,871,617 A 3/1975 Majima
3,874,244 A 4/1975 Rasmussen et al.
3,891,186 A 6/1975 Thorsell
3,907,042 A 9/1975 Halwas et al.
3,909,149 A 9/1975 Century
3,952,796 A 4/1976 Larson
3,999,392 A 12/1976 Fukushima et al.
4,033,419 A 7/1977 Pennington
4,067,369 A 1/1978 Harmon
4,082,361 A 4/1978 Lanfermann
4,100,974 A 7/1978 Pepe
4,113,034 A 9/1978 Carlson
4,143,985 A 3/1979 Axelsson et al.
4,144,939 A 3/1979 Knothe
4,155,600 A 5/1979 Lanfermann et al.
4,166,508 A 9/1979 van den Berg
4,195,698 A 4/1980 Nakagawasai
4,274,761 A 6/1981 Boguth
4,285,405 A 8/1981 Weir
4,297,056 A * 10/1981 Nottingham ..... E02D 5/72 405/232
4,312,413 A 1/1982 Loftis
4,351,624 A 9/1982 Barber
4,375,927 A 3/1983 Kniep
4,397,199 A 8/1983 Jahn
4,428,699 A 1/1984 Juhola
4,455,105 A 6/1984 Juhola
4,519,729 A 5/1985 Clarke et al.
4,522,304 A 6/1985 Walter
4,537,527 A 8/1985 Juhola et al.
4,547,110 A 10/1985 Davidson
4,553,443 A 11/1985 Rossfelder et al.
4,601,615 A 7/1986 Cavalli
4,603,748 A 8/1986 Rossfelder et al.
4,606,427 A 8/1986 Beer
4,616,716 A 10/1986 Bouplon
4,625,811 A 12/1986 Tuenkers
4,627,768 A 12/1986 Thomas et al.
4,632,602 A 12/1986 Hovnanian
4,637,475 A 1/1987 England et al.
4,645,017 A 2/1987 Bodine
4,650,008 A 3/1987 Simson
4,735,270 A 4/1988 Fenyvesi
4,755,080 A 7/1988 Cortlever et al.
4,768,900 A 9/1988 Burland
4,813,814 A 3/1989 Shibuta et al.
4,819,740 A 4/1989 Warrington
4,863,312 A 9/1989 Cavalli
4,915,180 A 4/1990 Schisler
5,004,055 A 4/1991 Porritt et al.
5,088,565 A 2/1992 Evarts
5,106,233 A 4/1992 Breaux
5,117,925 A 6/1992 White
5,213,449 A 5/1993 Morris
5,240,348 A 8/1993 Breaux
5,244,316 A 9/1993 Wright et al.
5,253,542 A 10/1993 Houze
RE34,460 E 11/1993 Ishiguro et al.
5,263,544 A 11/1993 White
5,281,775 A 1/1994 Gremillion
5,343,002 A 8/1994 Gremillion
5,355,964 A 10/1994 White
5,388,931 A 2/1995 Carlson
5,410,879 A 5/1995 Houze
5,439,326 A 8/1995 Goughnour et al.
5,529,132 A 6/1996 Evarts
5,540,295 A 7/1996 Serrette
5,544,979 A 8/1996 White
5,549,168 A 8/1996 Sadler et al.
5,549,170 A 8/1996 Barrow
5,562,169 A 10/1996 Barrow
5,609,380 A 3/1997 White
5,653,556 A 8/1997 White
5,658,091 A 8/1997 Goughnour et al.
5,794,716 A 8/1998 White
5,800,096 A 9/1998 Barrow
5,811,741 A 9/1998 Coast et al.
5,860,482 A 1/1999 Gremillion et al.
6,039,508 A 3/2000 White
6,129,159 A 10/2000 Scott et al.
6,179,527 B1 1/2001 Goughnour
6,234,260 B1 5/2001 Coast et al.
6,250,426 B1 6/2001 Lombard
6,360,829 B1 3/2002 Naber et al.
6,386,295 B1 5/2002 Suver
6,394,704 B1 5/2002 Saeki et al.
6,427,402 B1 8/2002 White
6,431,795 B2 8/2002 White
6,447,036 B1 9/2002 White
6,543,966 B2 4/2003 White
6,557,647 B2 5/2003 White
6,582,158 B1 6/2003 Van Stein
6,648,556 B1 11/2003 White
6,672,805 B1 1/2004 White
6,732,483 B1 5/2004 White
6,736,218 B1 5/2004 White
6,896,448 B1 5/2005 White
6,908,262 B1 6/2005 White
6,942,430 B1 9/2005 Suver
6,988,564 B2 1/2006 White
7,080,958 B1 7/2006 Morris
7,168,890 B1 1/2007 Evarts
7,392,855 B1 7/2008 White
7,694,747 B1 4/2010 White
7,708,499 B1 5/2010 Evarts et al.
7,824,132 B1 11/2010 White
7,854,571 B1 12/2010 Evarts
7,914,236 B2 3/2011 Neville
7,950,877 B2 5/2011 Evarts

(56) References Cited

U.S. PATENT DOCUMENTS

| | | | |
|---|---|---|---|
| 8,070,391 | B2 | 12/2011 | White |
| 8,181,713 | B2 | 5/2012 | White |
| 8,186,452 | B1 | 5/2012 | White et al. |
| 8,434,969 | B2 | 5/2013 | White |
| 8,496,072 | B2 | 7/2013 | White |
| 8,763,719 | B2 | 7/2014 | White |
| 9,249,551 | B1 | 2/2016 | White |
| 9,255,375 | B2 | 2/2016 | Yingling et al. |
| 2001/0002230 | A1 | 5/2001 | White |
| 2005/0039952 | A1 | 2/2005 | Hill et al. |
| 2006/0198706 | A1 | 9/2006 | Neville |
| 2010/0266344 | A1 | 10/2010 | Plotkin et al. |
| 2010/0303552 | A1 | 12/2010 | Yingling et al. |
| 2011/0162859 | A1 | 7/2011 | White |
| 2012/0292062 | A1 | 11/2012 | White |
| 2013/0149040 | A1 | 6/2013 | Evarts |
| 2014/0056652 | A1* | 2/2014 | Suver ..... E02D 7/22 405/249 |
| 2014/0377011 | A1 | 12/2014 | Yingling et al. |
| 2015/0016893 | A1 | 1/2015 | Suver et al. |
| 2016/0356294 | A1 | 12/2016 | Fenwick et al. |
| 2017/0101759 | A1 | 4/2017 | Suver |
| 2017/0138133 | A1 | 5/2017 | Fenwick |

FOREIGN PATENT DOCUMENTS

| | | | |
|---|---|---|---|
| CN | 102296608 | B | 7/2015 |
| DE | 4010357 | A1 | 10/1990 |
| EP | 0172960A1 | A1 | 3/1986 |
| EP | 362158 | | 4/1990 |
| EP | 0526743 | B1 | 8/1995 |
| FR | 838717 | | 3/1939 |
| FR | 2560247 | | 8/1985 |
| GB | 2003769 | | 3/1979 |
| GB | 2023496 | | 1/1980 |
| GB | 2028902 | | 3/1980 |
| GB | 2043755 | | 10/1980 |
| GB | 2060742 | | 5/1981 |
| GB | 2069659 | A | 8/1981 |
| JP | 5494703 | | 7/1979 |
| JP | 355098526 | | 7/1980 |
| JP | 356034828 | | 4/1981 |
| JP | 57169130 | | 10/1982 |
| JP | 59228529 | A | 12/1984 |
| JP | 61221416 | | 10/1986 |
| JP | 0258627 | | 2/1990 |
| JP | 473035 | | 2/1992 |
| JP | 497015 | A | 3/1992 |
| JP | 6136751 | | 5/1994 |
| JP | 2005256500 | A | 9/2005 |
| JP | 2005315050 | A | 11/2005 |
| JP | 2006089933 | A | 4/2006 |
| JP | 2006177125 | A | 7/2006 |
| JP | 2006312825 | A | 11/2006 |
| JP | 2009138487 | A | 6/2009 |
| NL | 42349 | | 1/1938 |
| NL | 65252 | | 2/1950 |
| NL | 7710385 | | 3/1978 |
| NL | 7707303 | | 1/1979 |
| NL | 7805153 | | 11/1979 |
| NO | 46428 | | 4/1929 |
| RU | 2109881 | * | 4/1998 |
| SU | 1027357 | | 7/1983 |
| WO | WO8707673 | | 12/1987 |
| WO | WO8805843 | | 8/1988 |
| WO | 9600326 | A1 | 1/1996 |
| WO | 2012031108 | A1 | 3/2012 |

OTHER PUBLICATIONS

"Castle Board Drain Method", Japanese brochure, Reference Nos. APE00857 through APE00863, Aug. 1976.

"Kony Drain Board," undated, 1 page.

"The 1.sup.st Report on the Treatment of Soft Foundation of Juck Hyun Industrial Site", Ref. Nos. APE00854 through APE00856, Mar. 1976.

A report identifying systems for driving mandrels carrying wick drain material into the earth, identified by Ref. Nos. APE0510 through APE0536, (undated).

A series of photographs identified by reference Nos. APE01147 through APE01159. 1990-1993.

International Construction Equipment, Inc "Hydraulic Vibratory Driver/Extractors for Piling and Caisson Work," 10 pages.

International Construction Equipment, Inc "Hydraulic Vibratory Driver/Extractors for Piling and Caisson Work," Ref. No. V7-0890-51, 1974, 3 pages.

Schematic drawings identified by Ref. Nos. APE01038, APE01039, (updated).

USPTO, "Non-Final Office Action, U.S. Appl. No. 15/285,326," dated Dec. 28, 2017, 17 pages.

USPTO, "Final Office Action, U.S. Appl. No. 15/285,326,", dated Aug. 14, 2017, 10 pages.

* cited by examiner

SYSTEMS AND METHODS FOR INSTALLING PILE STRUCTURES IN PERMAFROST

RELATED APPLICATIONS

This application, U.S. patent application Ser. No. 15/372,196 filed Dec. 7, 2016 claims benefit of U.S. Provisional Application Ser. No. 62/266,379 filed Dec. 11, 2015, the contents of which are incorporated herein by reference.

TECHNICAL FIELD

The present invention relates to pile driving systems and methods and, in particular, to systems and methods for installing pile structures in permafrost ground.

BACKGROUND

In construction projects, the need often exists to support a structure relative to a desired location of the ground. Piles may be used to support the structure relative to the ground. In particular, a predetermined type of pile may be driven into the ground at the desired location to a predetermined pile depth. The type of pile and pile depth are typically predetermined based on conditions such as the nature of the structure (e.g., load) to be supported by the pile and the conditions of the ground at and below the desired location.

The term "permafrost" is typically used to refer to ground, including rock or soil, at or below the freezing point of water. While many of the techniques employed when driving piles in conventional (e.g., non-frozen) soil may be used in permafrost, the characteristics of permafrost present a unique set of considerations when a pile is to be driven into permafrost.

The need thus exists for pile driving systems and methods optimized for use in permafrost.

SUMMARY

The present invention is a pile system for permafrost comprising a pilot hole, at least one pile, and frozen slurry. The pilot hole is formed to a pilot hole depth. The at least one pile is arranged at least partly within the pilot hole and extending to a pile string depth. The frozen slurry is within the pilot hole and is at least partly around the at least one pile.

The present invention is a method of forming a pile system for permafrost comprising the following steps. A mandrel is displaced to form a pilot hole to a pilot hole depth and to create a slurry at least partly within the pilot hole. The mandrel is removed from the pilot hole. While the slurry is at least partly flowable, at least one pile is arranged at least partly within the pilot hole to a pile string depth. Slurry is allowed to freeze within the pilot hole at least partly around the at least one pile.

The present invention may also be embodied as a method of forming a pile system for permafrost comprising the following steps. A mandrel, a lead pile, and an extension pile are provided. A drive system is operated to rotate the mandrel to form a pilot hole to a pilot hole depth and to create a slurry at least partly within the pilot hole. The mandrel is removed from the pilot hole. While the slurry is at least partly flowable, the drive system is operated to rotate the lead such that the lead pile is arranged at least partly within the pilot hole. The extension pile is connected to the lead pile to form at least part of a pile string. While the slurry is at least partly flowable, the drive system is operated to rotate the extension pile such that the lead pile is arranged within the pile hole and the extension pile is arranged at least partly within the pilot hole. The slurry is allowed to freeze within the pilot hole at least partly around the lead pile and the extension pile.

DETAILED DESCRIPTION

Figure 6:
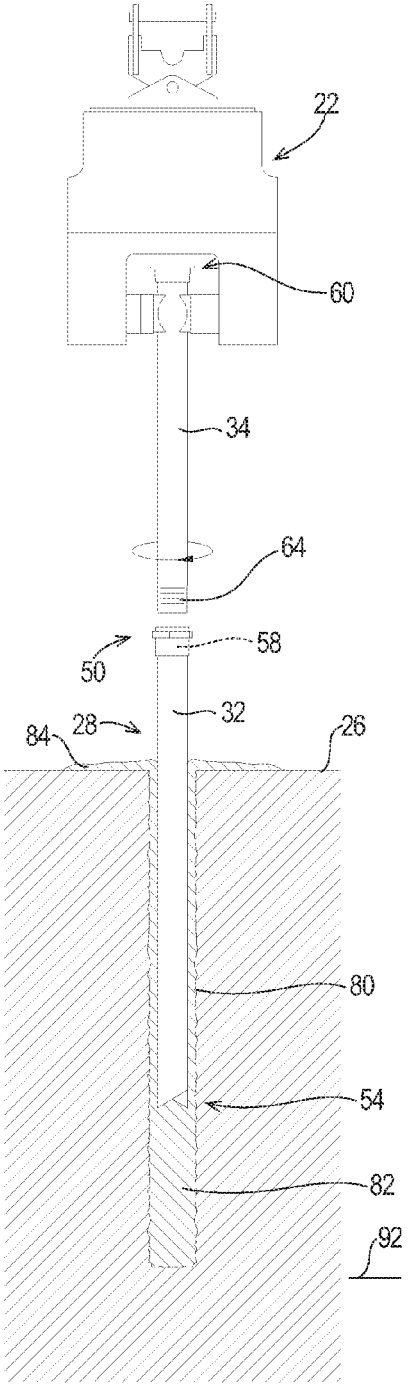
FIG. 6 is a side elevation view illustrating a fourth point in time during the process of installing a pile structure in accordance with the principles of the present invention.
Figure 7:
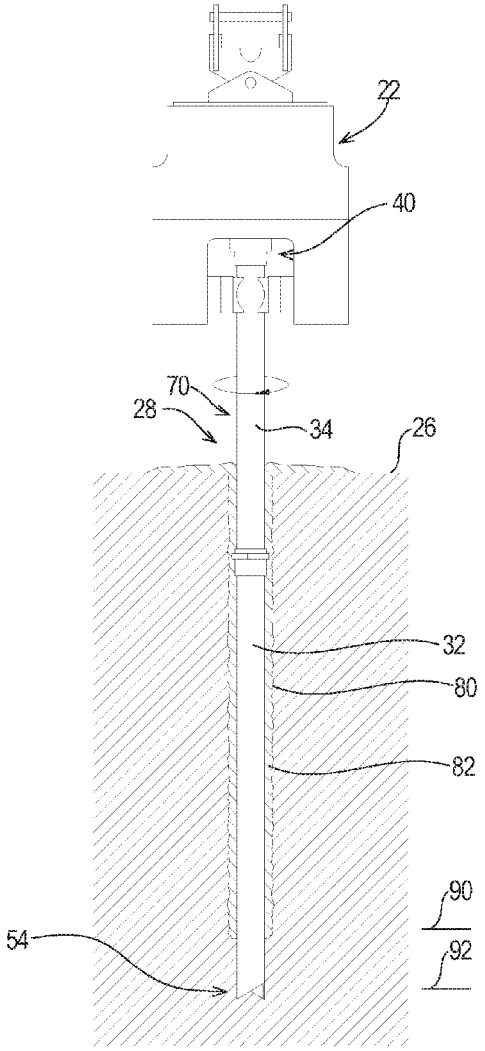
FIG. 7 is a side elevation view illustrating a fourth point in time during the process of installing a pile structure in accordance with the principles of the present invention.
Figure 8:
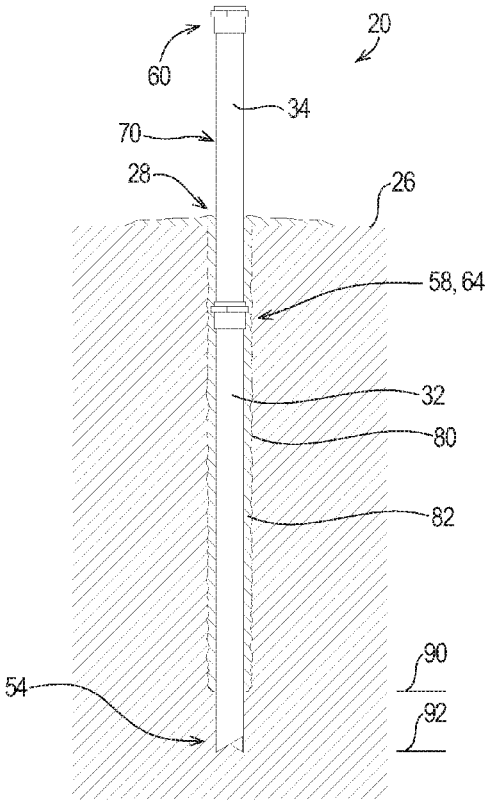
FIG. 8 is a side elevation view of a pile structure installed in accordance with the principles of the present invention.
Figure 9:
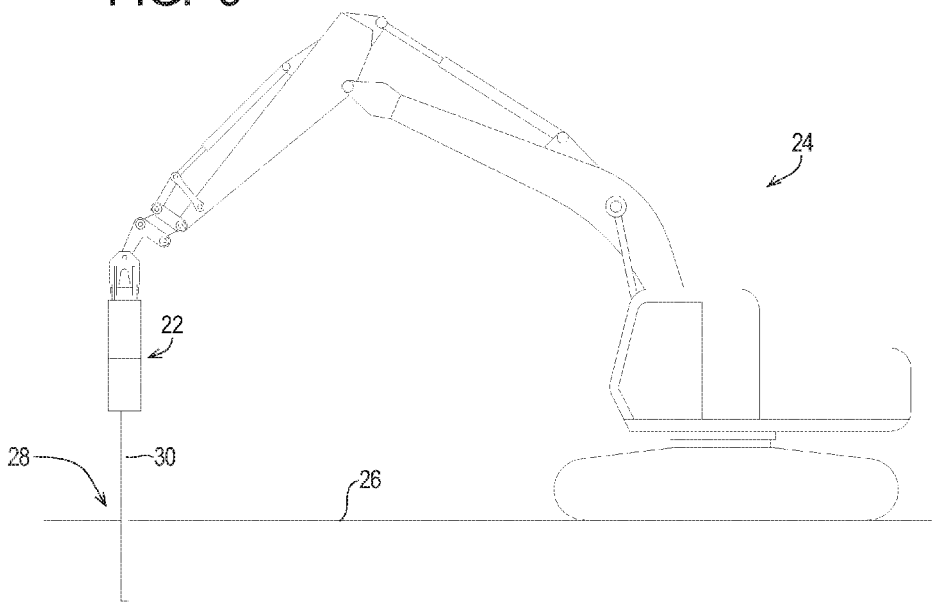
FIG. 9 illustrates a side elevation view of a system that may be used to perform the process of installing a pile structure in accordance with the principles of the present invention.

FIGS. 1-7 of the drawing illustrate various points during the process of installing an example pile system 20 as depicted in FIG. 8. FIGS. 1-7 also depict a drive system 22 capable of supporting an elongate member and rotating the elongate member that may be used as part of the method of forming the example pile system 20. The example drive system 22 may be or incorporate, for example, a pile driving system as disclosed in the Applicant's copending U.S. patent application Ser. No. 14/321,632. As shown in FIG. 9, the drive system 22 may be supported by a support system 24. In the example, depicted in FIG. 9, the support system 24 is a conventional excavator, but any other system capable of supporting a drive system such the example drive system 22 may be used in place of the excavator. Together, the support system 24 and drive system 22 allow an elongate member to be driven into the ground 26 at a desired location 28 as will be described in further detail below.

Figure 1:
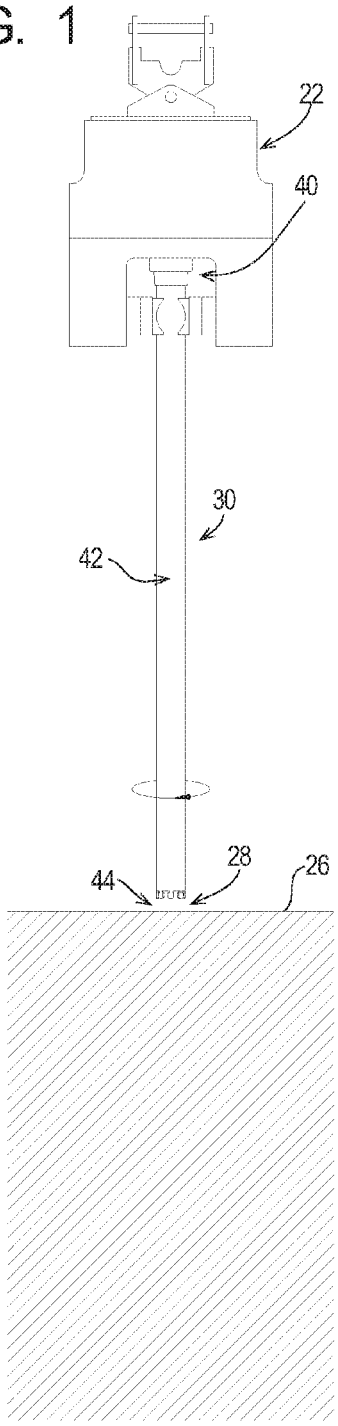
FIG. 1 is a side elevation view illustrating a first point in time during a process of installing a pile structure in accordance with the principles of the present invention.
Figure 2:
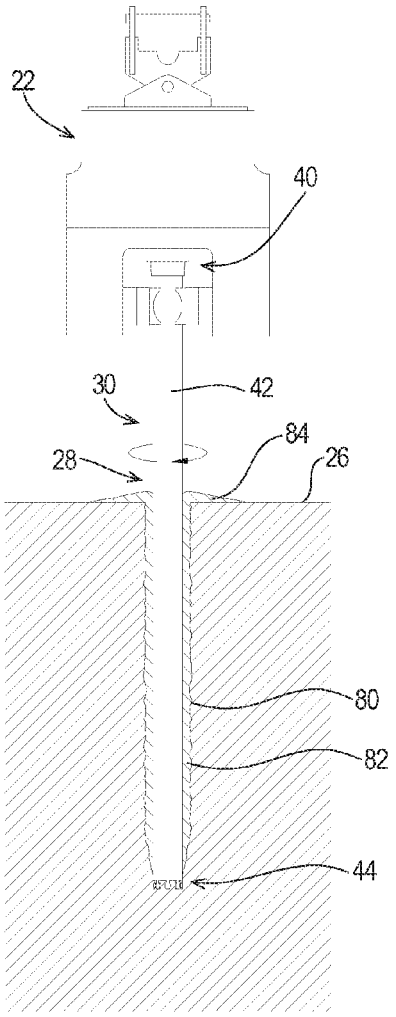
FIG. 2 is a side elevation view illustrating a second point in time during the process of installing a pile structure in accordance with the principles of the present invention.
Figure 3:
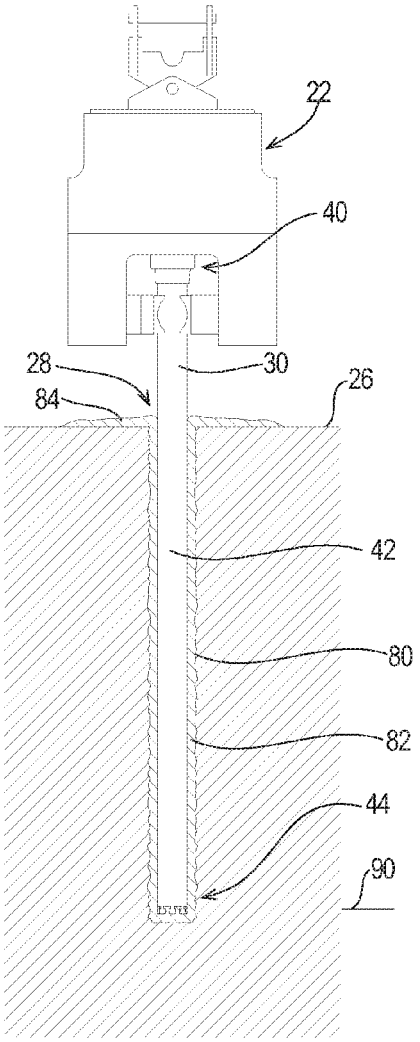
FIG. 3 is a side elevation view illustrating a third point in time during the process of installing a pile structure in accordance with the principles of the present invention.

In FIGS. 1-3, the drive system 22 is shown rotating an elongate member in the form of a mandrel 30. In FIGS. 4-7, the drive system 22 is shown rotating an elongate member in the form of a lead pile 32 and one or more extension piles 34. In the example shown in FIGS. 1-8, only one extension pile 34 is used, but more extension piles may be used depending on the circumstances. For purposes of simplicity and clarity, FIG. 9 illustrates the drive system 30 supporting the mandrel 30, but the drive system 30 is also capable of supporting the lead pile 32 (see, e.g., FIGS. 4 and 5) or the extension piles 34 (see, e.g., FIGS. 6 and 7).

Figure 10:
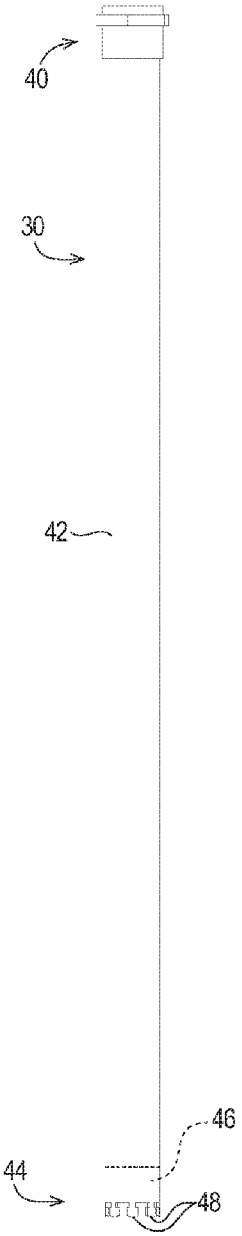
FIG. 10 is a side elevation view of an example mandrel that may be used by a pile driving system of the present invention.

FIG. 10 depicts the example mandrel 30. The example mandrel assembly 30 comprises a drive portion 40, a shaft portion 42, and a bit portion 44. The drive portion 40 is or may be conventional and is adapted to engage the drive system 22 to allow the drive system to axially rotate of the mandrel 30. The example bit portion 44 is formed by a prefabricated insert 46 made of 4140 steel that houses replaceable teeth 48. The use of the insert 46 with replaceable teeth 48 allows the integrity of the bit portion 44 to be maintained as it is used and provides the ability for rapid rebuild if necessary. Other characteristics of the bit portion 44 will be described below.

Figure 11:
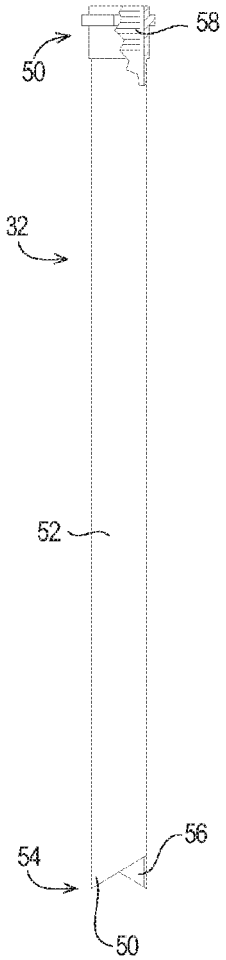
FIG. 11 is a side elevation view of an example lead pile that may be used by a pile driving system of the present invention.

FIG. 11 depicts the example lead pile 32. The example lead pile 32 comprises a drive portion 50, a shaft portion 52, and a cutter portion 54. Like the drive portion 40 of the mandrel 30, the drive portion 50 is or may be conventional and is adapted to engage the drive system 22 to allow the drive system to axially rotate of the lead pile 32. The example cutter portion 54 is formed by a Z-cut on the end of the lead pile 32 defining two or more integral cutting teeth 56. The integral cutting teeth 56 provide the lead piles 32 with limited short term cutting ability as will be described below, but without the durability or replaceability of the bit portion 44 of the lead pile 32. FIG. 11 further illustrate a trailing threaded portion 58 formed within the lead pile 32 at the upper end adjacent to the drive portion 50. The example trailing threaded portion 58 takes the form of internal threads.

Figure 12:
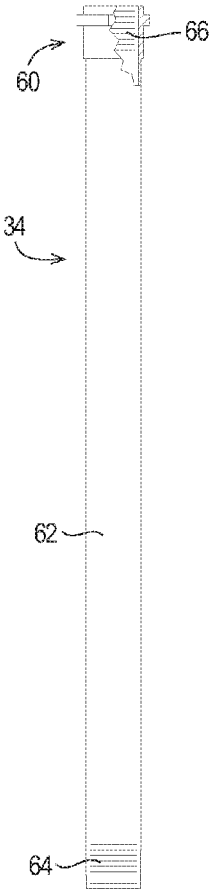
FIG. 12 is a side elevation of an example extension pile that may be used by a pile driving system of the present invention.

FIG. 12 depicts the example extension piles 34. The example extension pile(s) 34 comprises a drive portion 60, a shaft portion 62, a leading threaded portion 64, and a trailing threaded portion 66. Like the drive portion 40 of the mandrel 30 and the drive portion 50 of the lead pile 32, the drive portion 60 is or may be conventional and is adapted to engage the drive system 22 to allow the drive system to axially rotate of the extension pile 34. The example leading threaded portion 64 is takes the form of external threads on the end of the pile 32. The internally threaded trailing threaded portion 58 of the lead pile 32 receives the externally threaded leading portion 64 of the extension pile 34. If more than one extension pile is used, the internally threaded trailing threaded portion 66 of the first extension pile receives the externally threaded leading portion 64 of the next extension pile 34. In this manner a string of one lead pile 32 and at least one extension pile 34 may be used to form a pile string. FIGS. 7 and 8 illustrate a pile string 70 comprising a single lead pile 32 and a single extension pile 34.

Additionally, an internally threaded trailing threaded portion (not shown) may be formed on the mandrel 30. One or more extension piles 34 may be coupled to the mandrel 30 to allow the mandrel 30 to be driven to a depth greater than its length.

Referring now back to FIG. 1-7, the process of forming the example pile system 20 comprising the example pile string 70 will now be described in further detail. Initially, it should be noted that pile string is particularly suited to be used when the ground 26 is formed by what is commonly referred to as permafrost. The ground 26 is thus very cold, and any moisture therein will be frozen.

The mandrel 30 is coupled to the drive system 22 and axially rotated while suspended above the desired location 28 in the ground 26 as shown in FIG. 1. The drive system 22 and mandrel 30 are then lowered or crowded into the ground 26 while the mandrel 30 is axially rotated such that the mandrel 30 penetrates the ground 26 and forms a pilot hole 80 in the ground 26 at the desired location 28 as shown in FIG. 2. As the mandrel 30 penetrates the ground 26, the teeth 46 cut into and abrade the dirt and rock of the ground 26 around the pilot hole 80, creating friction.

The friction created by the teeth 46 heats up the mandrel 30, and the mandrel 30 in turn heats up the ground 26. Liquids in the heated ground 26 melt, creating a slurry 82 within the pilot hole 80. The teeth 46, the material from which the teeth 46 are made, the diameter of the mandrel 30, and speed at which the mandrel 30 is rotated are all controlled such that melted liquids forming at least part of the slurry 82 heat up and expand such that at least a portion of the slurry 82 flows to the surface. Accordingly, at least a portion of the slurry 82 will typically be forced up the pilot hole 80 and form a pool 84 of the slurry 82 on the ground surface where the mandrel enters the ground 26.

After the mandrel 30 reaches a pilot hole target depth 90 predetermined based on factors such as characteristics of the ground 26 and characteristics of the load (not shown) to be supported by the pile string 70 as shown in FIG. 3, the mandrel 30 is removed and detached from the drive system 22. Extensions to the mandrel 30 may be used to allow the example mandrel to reach the pilot hole target depth 90.

Figure 4:
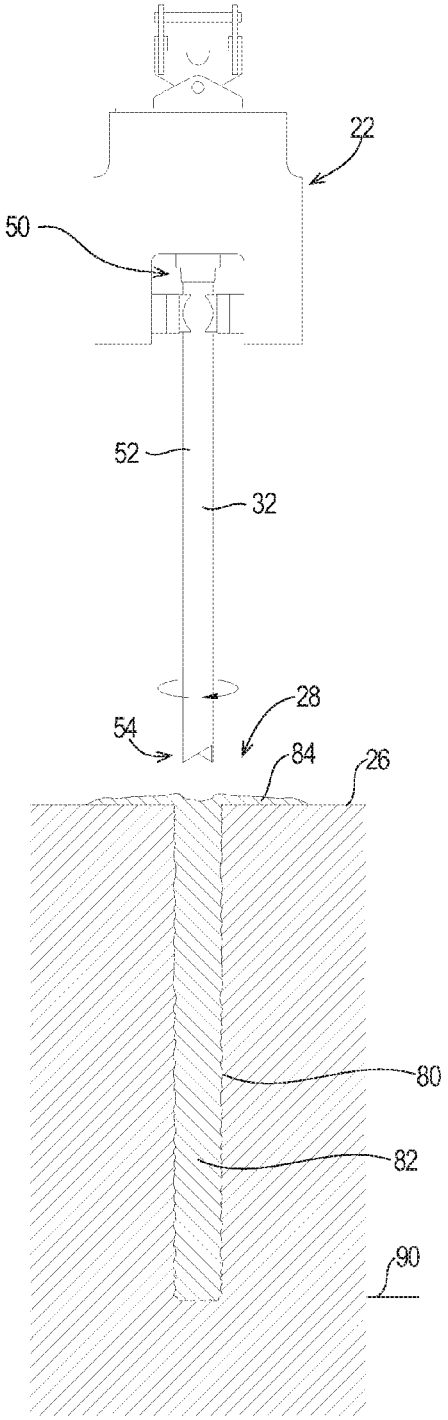
FIG. 4 is a side elevation view illustrating a third point in time during the process of installing a pile structure in accordance with the principles of the present invention.
Figure 5:
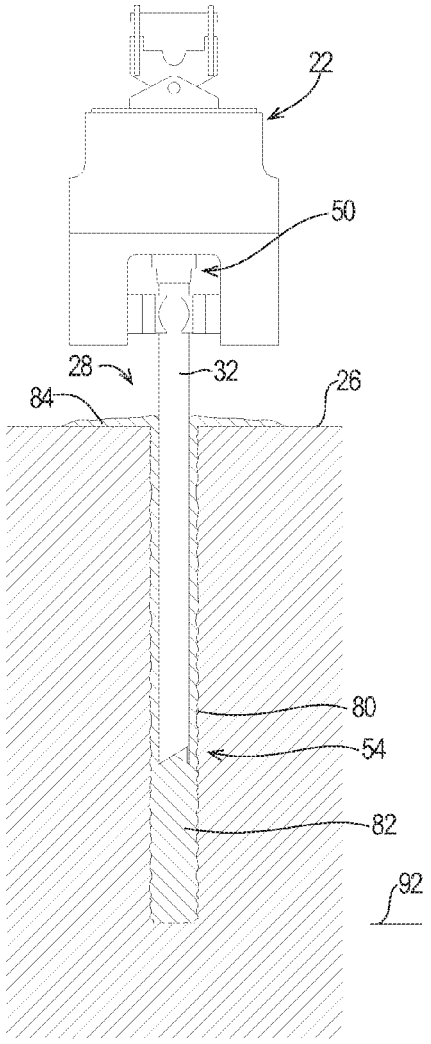
FIG. 5 is a side elevation view illustrating a fourth point in time during the process of installing a pile structure in accordance with the principles of the present invention.

At this point, while the slurry 82 is still melted and at least partly flowable, the lead pile 32 is connected to the drive system 22 and supported above the pilot hole 80 as shown in FIG. 4. The drive system 22 and lead pile 32 are then lowered and the lead pile 32 rotated such that the cutter portion 54 of the lead pile 32 enters the pilot hole 80. While the cutter portion 54 of the lead pile 32 does not have the cutting capacity of the bit portion 44 of the mandrel 30, the cutter portion 54 is sufficiently strong and durable to cut through the slurry 82 still in the flowable state. Further, the cutter portion 54 will create friction that will add heat to the slurry 82 as the lead pile 32 is axially rotated while being inserted into the pilot hole 80. The lead pile 32 is inserted to a depth at which the drive portion 50 thereof is still accessible as shown in FIG. 5, after which the drive system 22 is disconnected from the lead pile 32.

Again, while the slurry 82 is still melted and flowable, the extension pile 34 is connected to the drive system 22. The extension pile 34 is supported above the pilot hole 80 as shown in FIG. 6 and then rotated such that the threaded portion 58 on the lead pile 32 receives the threaded portion 64 on the extension pile 34 to connect the extension pile 34 to the lead pile 32 to form the pile string 70. The drive system 22 and pile string 70 are then lowered and the pile string 70 axially rotated such that the cutter portion 54 of the lead pile 32 continues through the slurry 82 within the pilot hole 80. Again, the cutter portion 54 is sufficiently strong and durable to cut through the slurry 82 still in the flowable state and will create friction that will add heat to the slurry 82 as the pile string 70 is axially rotated while being inserted into the pilot hole 80. Further, the cutter portion 54 of the lead pile 32 is sufficiently strong to penetrate beyond the pilot hole depth 90 as shown in FIG. 7.

Accordingly, additional rotation of the pile string 70 will continue to cut into the ground 26 beyond the pilot hole depth 90. When the drill string 70 reaches a target drill string depth 92 that is below the pilot hole depth 90 as shown in FIG. 7, the rotational and crowding forces are no longer applied to the drill string 70. Again, the target drill string depth 92, and possibly the distance between the pilot hole depth and the target string depth 92, will typically be predetermined based on requirements of the load and characteristics (e.g., soil conditions) of the ground 26 at the desired location 28. The drive system 22 is then removed from the drill string 70, and the slurry 82 is allowed to refreeze, securing the pile string 70 in a desired orientation at the desired location 28 as shown in FIG. 8.

When the pile string 70 is secured in the desired orientation at the desired location 28 as shown in FIG. 8, the example pile system 20 is formed by the pile string 70, the ground 26 around the pile string 70, and the frozen slurry 82 adjacent to the pile string 70. At this point, a structure or load may be supported by the pile string 70 in a conventional manner. The Applicant's copending U.S. Provisional patent application Ser. No. 15/174,724 discloses Systems and Methods for Connecting a Structural Member to a Pile that may be used on the uppermost extension pile 34 of the pile string 70 depicted in FIG. 8. However, other systems and methods may be used to secure a structure to the pile string 70.

In this specification, the use of a letter suffix with any reference character does not necessarily indicate that an element generically identified by that reference character is different from an element specifically identified by the reference character with a letter suffix. Accordingly, any reference character used without a letter suffix in the specification may generally refer to the same reference character used with a letter suffix in the drawing.

What is claimed is:

1. A method of forming a pile system for permafrost comprising the steps of:

rotating a mandrel to form a pilot hole to a pilot hole depth, where friction created by engagement with the mandrel and the permafrost melts liquids in the permafrost, thereby creating a flowable slurry at least partly within the pilot hole;

removing the mandrel from the pilot hole;

while the slurry is at least partly flowable, arranging at least one pile at least partly within the pilot hole to a pile string depth; and allowing slurry to freeze within the pilot hole at least partly around the at least one pile.

2. The method as recited in claim 1, in which the at least one pile comprises a lead pile.

3. The method as recited in claim 1, in which the at least one pile comprises an extension pile.

4. The method as recited in claim 1, in which the step of arranging the at least one pile at least partly within the pilot hole comprises the steps of:

providing a plurality of piles; and forming a pile string comprising a plurality of piles.

5. The method as recited in claim 4, in which the step of providing a plurality of piles comprises the step of providing a lead pile and at least one extension pile.

6. The method as recited in claim 4, in which the step of forming the pile string further comprises the steps of:

arranging the lead pile at least partly within the pilot hole;

connecting a first extension pile to the lead pile to form at least part of the pile string; and displacing the at least part of the pile string formed by the lead pile and the first extension pile such that the first extension pile is arranged at least partly within the pilot hole.

7. The method as recited in claim 6, in which the step of forming the pile string further comprises the steps of:

connecting a second extension pile to the first extension pile to form at least part of the pile string; and displacing the at least part of the pile string formed by the lead pile and the first and second extension piles such that the second extension pile is arranged at least partly within the pilot hole.

8. The method as recited in claim 1, in which the pile string depth extends beyond the pilot hole depth.

9. The method as recited in claim 1, further comprising the step of predetermining the pile string depth based on at least one of:

ground characteristics at a desired location at which the pilot hole is to be formed; and a load to be supported by the pile string after the slurry has been allowed to freeze.

10. A method of forming a pile system for permafrost comprising the steps of:

providing a mandrel;

providing a lead pile;

providing at least one extension pile;

operating a drive system to rotate the mandrel to form a pilot hole to a pilot hole depth, where friction created by engagement with the mandrel and the permafrost melts liquids in the permafrost, thereby creating a flowable slurry at least partly within the pilot hole;

removing the mandrel from the pilot hole;

while the slurry is at least partly flowable, operating the drive system to rotate the lead pile such that the lead pile is arranged at least partly within the pilot hole;

connecting the at least one extension pile to the lead pile to form at least part of a pile string;

while the slurry is at least partly flowable, operating the drive system to rotate the at least one extension pile such that the lead pile is arranged within the pile hole and the at least one extension pile is arranged at least partly within the pilot hole; and allowing slurry to freeze within the pilot hole at least partly around the lead pile and the at least one extension pile.

11. The method as recited in claim 10, in which the step of arranging the lead pile and the at least one extension pile at least partly within the pilot hole comprises the steps of:

providing a plurality of extension piles; and forming the pile string by connecting one of the plurality of extension piles to the lead pile and one of the plurality of extension pile to the extension pile connected to the lead pile.

12. The method as recited in claim 11, further comprising the step of rotating at least a portion of the pile string such that the pile string extends to a pile string depth.

13. The method as recited in claim 12, in which the pile string depth extends beyond the pilot hole depth.

14. The method as recited in claim 12, further comprising the step of predetermining the pile string depth based on at least one of:

ground characteristics at a desired location at which the pilot hole is to be formed; and a load to be supported by the pile string after the slurry has been allowed to freeze.

* * * * *